US011850646B2

(12) United States Patent
Nojiri

(10) Patent No.: US 11,850,646 B2
(45) Date of Patent: Dec. 26, 2023

(54) MANUFACTURING APPARATUS AND MANUFACTURING METHOD FOR HAT-SHAPED SECTION COMPONENT WITH CURVED PROJECTION PORTION

(71) Applicant: TOYOTA JIDOSHA KABUSHIKI KAISHA, Toyota (JP)

(72) Inventor: Isao Nojiri, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 150 days.

(21) Appl. No.: 16/922,258

(22) Filed: Jul. 7, 2020

(65) Prior Publication Data

US 2021/0078064 A1 Mar. 18, 2021

(30) Foreign Application Priority Data

Sep. 13, 2019 (JP) ..... 2019-166922

(51) Int. Cl.
*B21D 22/02* (2006.01)

(52) U.S. Cl.
CPC ..... *B21D 22/025* (2013.01)

(58) Field of Classification Search
CPC ..... B21D 22/025; B21D 22/20; B21D 22/22; B21D 22/24; B21D 22/26; B21D 22/04; B21D 22/08; B21D 24/06; B21D 24/08
(Continued)

(56) References Cited

U.S. PATENT DOCUMENTS 8,429,946 B2 * 4/2013 Maeda ..... B21D 22/02 72/453.13
2008/0066515 A1 * 3/2008 Iwashita ..... G05B 19/237 72/351

(Continued)

FOREIGN PATENT DOCUMENTS

CN 107107148 A 8/2017
JP 60-171621 U 11/1985

(Continued)

OTHER PUBLICATIONS

JPS60-171621 MT (machine translation of unexamined JP patent1984) (Year: 1984).*

(Continued)

*Primary Examiner* — Adam J Eiseman
*Assistant Examiner* — Fred C Hammers
(74) *Attorney, Agent, or Firm* — Oblon, McClelland, Maier & Neustadt, L.L.P.

(57) ABSTRACT

Provided is a manufacturing apparatus for manufacturing a hat-shaped section component including a curved projection portion such that a to-become-top-plate portion is pressed by a punch in a state where a to-become-flange portion is sandwiched between a die and a holder. The manufacturing apparatus includes the punch having a first mold surface including a curved projection portion mold surface, the holder, and the die having a fourth mold surface facing the first mold surface. An opening is formed in a part, of the fourth mold surface, that corresponds to the curved projection portion mold surface. The manufacturing apparatus includes a pad provided in the die and having a fifth mold surface facing the curved projection portion mold surface, the pad being configured to be relatively movable upward against downward biasing force so that the fifth mold surface becomes flush with the fourth mold surface.

11 Claims, 11 Drawing Sheets

(58) Field of Classification Search
USPC ..... 72/352, 351
See application file for complete search history.

(56) References Cited

U.S. PATENT DOCUMENTS

| | | | | |
|---|---|---|---|---|
| 2015/0367397 | A1 | 12/2015 | Uchiyama et al. | |
| 2016/0221068 | A1 | 8/2016 | Tanaka et al. | |
| 2018/0264534 | A1* | 9/2018 | Aso | B21D 47/01 |
| 2023/0127151 | A1* | 4/2023 | Miyake | B21D 24/02<br>72/349 |

FOREIGN PATENT DOCUMENTS

| | | | |
|---|---|---|---|
| JP | 2014-240078 | A | 12/2014 |
| WO | WO 2014/112056 | A1 | 7/2014 |
| WO | WO 2015/046023 | A1 | 4/2015 |

OTHER PUBLICATIONS

Partial English translation of Japanese Office Action dated Aug. 2, 2022 in Japanese Patent Application No. 2019-166922, 2 pages.

* cited by examiner

MANUFACTURING APPARATUS AND MANUFACTURING METHOD FOR HAT-SHAPED SECTION COMPONENT WITH CURVED PROJECTION PORTION

INCORPORATION BY REFERENCE

The disclosure of Japanese Patent Application No. 2019-166922 filed on Sep. 13, 2019 including the specification, drawings and abstract is incorporated herein by reference in its entirety.

BACKGROUND

1. Technical Field

The present disclosure relates to a manufacturing apparatus and a manufacturing method each for a component having a hat-shaped section (hereinafter also referred to as a "hat-shaped section component") with a curved projection portion curved in a longitudinal direction.

2. Description of Related Art

In a case where a hat-shaped section component used for a vehicle frame member and so on is manufactured, press working (drawing) is often performed on a metal flat-shaped workpiece by use of a manufacturing apparatus such that the workpiece has a hat-shaped section, the manufacturing apparatus including a die, a punch, a holder, and so on as a metal mold.

More specifically, in a case where a hat-shaped section component is manufactured, a manufacturing apparatus including, as a metal mold, a die having an opening, a punch placed to face the opening of the die, and a holder placed to face the die is prepared. In most cases, in a state where to-become-flange portions (parts of a workpiece that are to become flanges after molding) are sandwiched between the die and the holder on both outer sides of a to-become-top-plate portion (a part of the workpiece to become a top plate after molding) in the width direction, the punch enters the opening of the die while the punch pushes the to-become-top-plate portion into the opening, so that a vertical wall is molded between the top plate and each of the flanges.

In the meantime, the following case has been known. That is, in a case where a hat-shaped section component including a curved projection portion curved in its longitudinal direction is manufactured, if a to-become-top-plate portion is not pressed by a pad so as to prevent occurrence of longitudinal displacement (slip) in a workpiece, the to-become-top-plate portion is displaced in the longitudinal direction in the course of stretch-flanging (molding of a vertical wall between a top plate and a flange), thereby resulting in that a crack is formed in the top plate.

On this account, generally, in a case where a hat-shaped section component including a curved projection portion is manufactured, a pad is added as the metal mold, and the hat-shaped section component is manufactured while a to-become-top-plate portion of a workpiece is restricted by the pad over its whole length in the longitudinal direction (while the to-become-top-plate portion is sandwiched between the pad and a punch) (for example, see WO 2015/046023).

SUMMARY

In the meantime, in a case where the hat-shaped section component is manufactured with the to-become-top-plate portion being restricted by the pad over the whole length in the longitudinal direction, relatively large biasing force that does not cause longitudinal displacement in the workpiece is applied to the pad itself by biasing means such as a gas cylinder. On this account, it is necessary to secure the strength of the pad by relatively increasing the thickness of the pad. However, when the thickness of the pad is relatively increased, the following problem occurs.

That is, at the time when the workpiece is introduced into the metal mold, it takes time until a bottom end of the pad reaches a sufficient height (a height at which a gap to such an extent that the workpiece can be inserted therein is formed between upper ends of the punch and the holder and the bottom end of the pad) by raising a slide of a press machine. On this account, when the thickness of the pad is relatively increased, it takes longer time before the bottom end of the pad reaches a sufficient height after completion of molding of the hat-shaped section component, that is, it takes longer time before a subsequent workpiece is introduced into the metal mold. This causes such a problem that the productivity decreases.

The present disclosure is accomplished in view of such a problem, and an object of the present disclosure is to provide a technology to restrain a decrease in productivity and occurrence of a crack in a top plate when a hat-shaped section component including a curved projection portion is manufactured.

In order to achieve the above object, in a manufacturing apparatus and a manufacturing method, according to the present disclosure, for a hat-shaped section component including a curved projection portion, a workpiece is not restricted over the whole length in its longitudinal direction, and only a part (a curved projection portion after molding), of the workpiece, where longitudinal displacement easily occurs and its surrounding part are restricted by a pad.

More specifically, the present disclosure is targeted for a manufacturing apparatus for manufacturing a hat-shaped section component including a curved projection portion such that, in a state where a to-become-flange portion as a part to become a flange after molding in a flat-shaped workpiece is sandwiched between a die and a holder, a to-become-top-plate portion as a part to become a top plate after molding in the workpiece is pressed by a punch so that the hat-shaped section component having a vertical wall between the top plate and the flange is molded, and the curved projection portion curved in a longitudinal direction so as to project toward a first side in a pressing direction is formed in the hat-shaped section component.

The manufacturing apparatus includes the punch, the holder, and the die. The punch has a first mold surface facing toward the first side in the pressing direction, the first mold surface including a curved projection portion mold surface a part of which curves in the longitudinal direction so as to project toward the first side in the pressing direction. The holder has a pair of second mold surfaces facing toward the first side in the pressing direction, the second mold surfaces being provided on both outer sides of the first mold surface in the width direction. The die has a pair of third mold surfaces and a fourth mold surface, the third mold surfaces facing toward a second side in the pressing direction so as to face the second mold surfaces, the fourth mold surface being provided between the third mold surfaces via steps such that the fourth mold surface is placed to be closer to the first side in the pressing direction than the third mold surfaces, the fourth mold surface facing toward the second side in the pressing direction so as to face the first mold surface. The fourth mold surface has an opening opened toward the second side in the pressing direction, the opening being formed in a part, of the fourth mold surface, that corresponds to the curved projection portion mold surface. The manufacturing apparatus further includes a pad provided in the die and having a fifth mold surface facing toward the second side in the pressing direction so as to face the curved projection portion mold surface. The pad is configured to be relatively movable toward the first side in the pressing direction so as to be pushed into the opening against biasing force toward the second side in the pressing direction so that the fifth mold surface becomes flush with the fourth mold surface from a state where the fifth mold surface projects toward the second side in the pressing direction from the fourth mold surface.

In this configuration, while the to-become-top-plate portion is pressed by the first mold surface including the curved projection portion mold surface in a state where the to-become-flange portions are each sandwiched between a corresponding one of the second mold surfaces of the holder and a corresponding one of the third mold surfaces of the die, the punch is pushed into between the steps of the die. Hereby, the hat-shaped section component having the vertical wall between the top plate and each of the flanges is molded. Further, the to-become-top-plate portion is pressed by the curved projection portion mold surface partially curved in the longitudinal direction, so that the curved projection portion is formed in the top plate.

Here, as can be understood from a case where a flat component is molded by drawing, longitudinal displacement of the to-become-top-plate portion that might cause a crack in the top plate occurs such that displacement caused in a part (hereinafter also referred to as a "to-be-curved portion") corresponding to the curved projection portion is transmitted over the whole length in the longitudinal direction, and no longitudinal displacement occurs in a flat part other than the to-be-curved portion.

In this respect, in this configuration, when the punch is pushed into between the steps of the die, the to-be-curved portion pressed by the curved projection portion mold surface first abuts with the fifth mold surface projecting toward the second side in the pressing direction from the fourth mold surface and is sandwiched between the curved projection portion mold surface and the fifth mold surface, so that the to-be-curved portion is restricted in the longitudinal direction. When the punch is further pushed in a state where the to-be-curved portion is restricted by the curved projection portion mold surface and the fifth mold surface, the to-become-top-plate portion is sandwiched, in the pressing direction, between the first mold surface and a set of the fourth mold surface and the fifth mold surface flush with the fourth mold surface. Hereby, without causing longitudinal displacement in the to-become-top-plate portion, in other words, without causing a crack in the top plate, the top plate including the curved projection portion can be formed between the fourth and fifth mold surfaces and the first mold surface.

Besides, the workpiece is not restricted over the whole length in the longitudinal direction, and only the to-be-curved portion, of the workpiece, where longitudinal displacement easily occurs, and its surrounding part are partially restricted by the pad. Accordingly, the whole length of the pad can be relatively shortened. Hereby, it is possible to relatively decrease biasing force applied to the pad itself. As a result, it is possible to sufficiently secure the strength of the pad even when the thickness of the pad is relatively decreased. Therefore, the thickness of the pad is relatively decreased, so that it is possible to shorten the time before the bottom end of the pad reaches a sufficient height after completion of molding of the hat-shaped section component, that is, it is possible to shorten the time before a subsequent workpiece is introduced into the metal mold. This makes it possible to restrain a decrease in productivity.

Further, in the above manufacturing apparatus, the holder may be provided around the punch such that the holder is movable toward the second side in the pressing direction against biasing force toward the first side in the pressing direction from a state where the second mold surfaces are generally flush with the first mold surface. The vertical wall may be molded between the top plate and the flange by distancing, in the pressing direction, the pad and the punch pressing the to-become-top-plate portion with the to-become-top-plate portion being sandwiched between the pad and the punch from the die and the holder pressing the to-become-flange portion with the to-become-flange portion being sandwiched between the die and the holder.

Further, the present disclosure is targeted for a manufacturing method for manufacturing a hat-shaped section component including a curved projection portion by pressing a flat-shaped workpiece, the curved projection portion being curved in the longitudinal direction so as to project toward a first side in a pressing direction.

The manufacturing method includes preparing a manufacturing apparatus. The manufacturing apparatus includes a punch, a holder, a die, and a pad. The punch has a first mold surface facing toward the first side in the pressing direction, the first mold surface including a curved projection portion mold surface a part of which curves in the longitudinal direction so as to project toward the first side in the pressing direction. The holder has a pair of second mold surfaces facing toward the first side in the pressing direction, the second mold surfaces being provided on both outer sides of the first mold surface in the width direction. The die has a pair of third mold surfaces and a fourth mold surface, the third mold surfaces facing toward a second side in the pressing direction so as to face the second mold surfaces, the fourth mold surface being provided between the third mold surfaces via steps such that the fourth mold surface is placed to be closer to the first side in the pressing direction than the third mold surfaces, the fourth mold surface facing toward the second side in the pressing direction so as to face the first mold surface, the fourth mold surface having an opening opened toward the second side in the pressing direction, the opening being formed in a part, of the fourth mold surface, that corresponds to the curved projection portion mold surface. The pad is provided in the die and has a fifth mold surface facing toward the second side in the pressing direction so as to face the curved projection portion mold surface, the pad being configured to be relatively movable toward the first side in the pressing direction so as to be pushed into the opening against biasing force toward the second side in the pressing direction so that the fifth mold surface becomes flush with the fourth mold surface from a state where the fifth mold surface projects toward the second side in the pressing direction from the fourth mold surface.

The manufacturing method includes a molding step of molding the hat-shaped section component having a vertical wall between a top plate and a flange and forming the curved projection portion in the hat-shaped section component such that, in a state where a to-become-flange portion as a part to become the flange after molding in the workpiece is sandwiched between a corresponding one of the second mold surfaces and a corresponding one of the third mold surfaces, a to-become-top-plate portion as a part to become the top plate after molding in the workpiece is pressed by the first mold surface toward the first side in the pressing direction. In the molding step, the to-become-top-plate portion is pressed by the first mold surface while a part, in the to-become-top-plate portion, that corresponds to the curved projection portion is sandwiched between the fifth mold surface and the curved projection portion mold surface.

In this configuration, in the molding step, the to-become-top-plate portion is pressed by the punch (the first mold surface), while the to-be-curved portion is sandwiched between the fifth mold surface and the curved projection portion mold surface, in other words, while only a part, in the to-become-top-plate portion, where longitudinal displacement easily occurs and its surrounding part are restricted by the fifth mold surface and the curved projection portion mold surface. Accordingly, the top plate including the curved projection portion can be formed while occurrence of a crack in the top plate is restrained by use of the pad that is relatively short in the longitudinal direction. This accordingly makes it possible to relatively decrease the thickness of the pad. Hereby, it is possible to shorten the time before the bottom end of the pad reaches a sufficient height after completion of molding of the hat-shaped section component (the time before a subsequent workpiece is introduced into the metal mold). This makes it possible to restrain a decrease in productivity.

Further, in the manufacturing method, as the manufacturing apparatus, a manufacturing apparatus configured such that the holder is provided around the punch such that the holder is movable toward the second side in the pressing direction against biasing force toward the first side in the pressing direction from a state where the second mold surfaces are generally flush with the first mold surface may be prepared. In the molding step, the vertical wall may be molded between the top plate and the flange by distancing, in the pressing direction, the pad and the punch pressing the to-become-top-plate portion with the to-become-top-plate portion being sandwiched between the pad and the punch from the die and the holder pressing the to-become-flange portion with the to-become-flange portion being sandwiched between the die and the holder.

Further, in the manufacturing apparatus and the manufacturing method, the workpiece may be made of high tensile steel.

Restraint force (pad restraint force) by the pad for restraining a crack from being formed in the top plate in the course of stretch-flanging increases in proportion to the material strength and the plate thickness of the workpiece. In terms of this, the manufacturing apparatus and the manufacturing method of the present disclosure each of which can restrain a decrease in productivity and occurrence of a crack in the top plate by partially applying the pad restraint force can be preferably applied to a workpiece made of high tensile steel.

As described above, with the manufacturing apparatus and the manufacturing method, according to the present disclosure, each for a hat-shaped section component including a curved projection portion, it is possible to restrain a decrease in productivity and occurrence of a crack in a top plate.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

With reference to the drawings, the following describes an embodiment to carry out the present disclosure.

Figure 1:
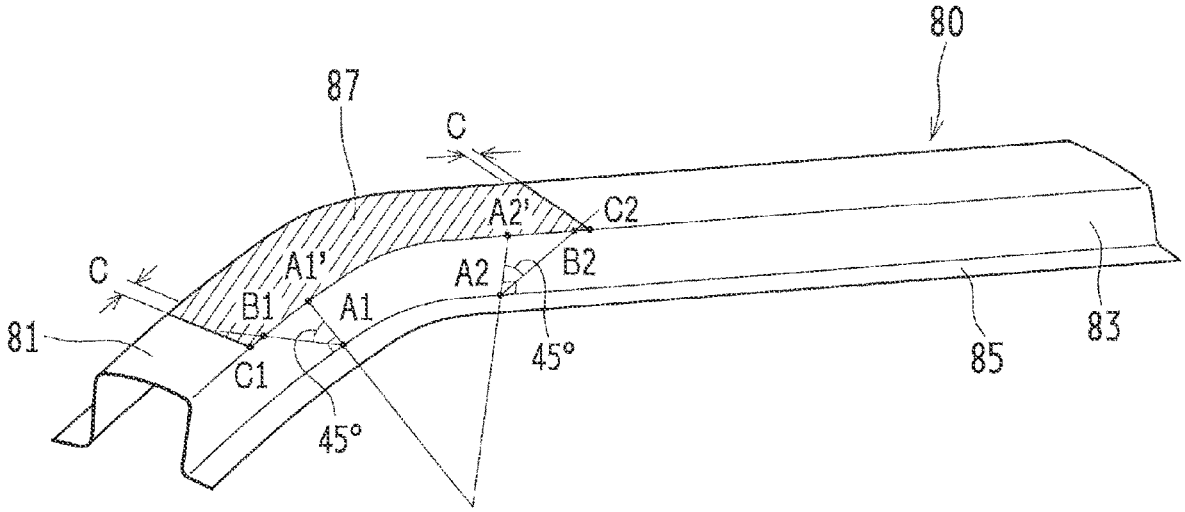
FIG. 1 is a perspective view schematically illustrating a hat-shaped section component manufactured by a manufacturing apparatus and a manufacturing method according to an embodiment of the present disclosure.
Figure 2:
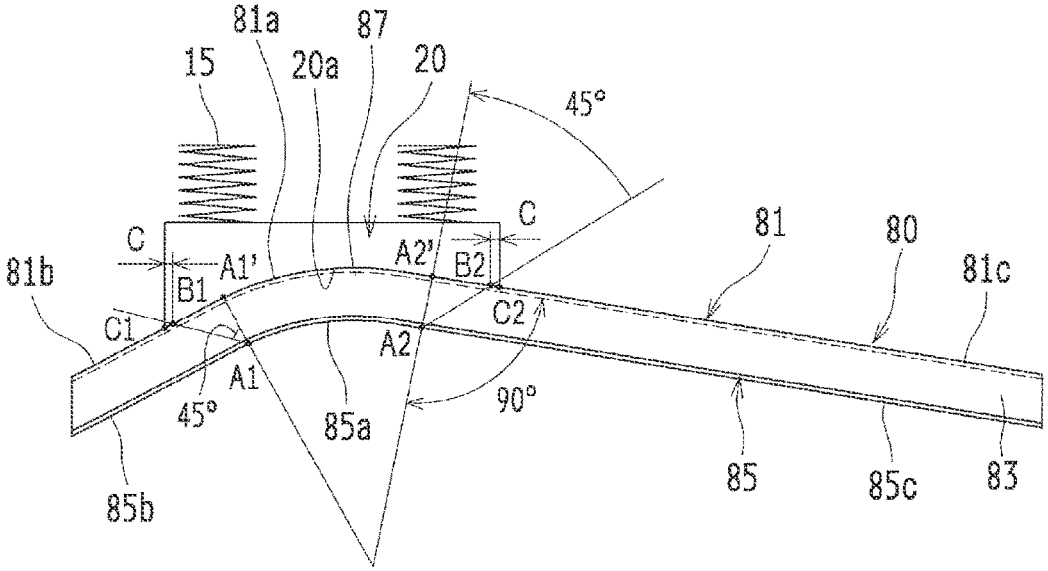
FIG. 2 is a side view schematically illustrating a relationship between the hat-shaped section component and a pad.

FIG. 1 is a perspective view schematically illustrating a hat-shaped section component 80 manufactured by a manufacturing apparatus 1 and a manufacturing method according to the present embodiment, and FIG. 2 is a side view schematically illustrating a relationship between the hat-shaped section component 80 and a pad 20. The hat-shaped section component 80 is manufactured by performing press working (drawing), by use of the manufacturing apparatus 1 (described below), on a flat-shaped workpiece 70 (see FIG. 2) made of high tensile steel (a high tensile material) having a tensile strength equal to or more than 490 MPa (preferably equal to or more than 980 MPa), for example.

As illustrated in FIG. 1, the hat-shaped section component 80 includes: a top plate 81 including a curved projection portion 87 curved in the longitudinal direction so as to project upward; a pair of vertical walls 83 hanging down from the opposite ends, in the width direction (a direction perpendicular to the longitudinal direction), of the top plate 81; and a pair of flanges 85 extending outward in the width direction from respective bottom end portions of the vertical walls 83. The hat-shaped section component 80 is formed to have a hat-like section opened downward and curves generally in a reverse V-shape along the longitudinal direction as a whole.

More specifically, in FIG. 2, a point A1 is an initial point of the curve in the flange 85, and a point A2 is an end point of the curve in the flange 85. That is, the flange 85 is formed such that a range 85*a* from the point A1 to the point A2 is formed as a curved portion curved in the longitudinal direction so as to project upward, and a range 85*b* on the left side from the point A1 and a range 85*c* on the right side from the point A2 are formed as flat portions.

On the other hand, in FIG. 2, a point A1 is an intersection point between a normal line drawn from the point A1 and the top plate 81 in a side view and is an initial point of the curve in the top plate 81. Further, a point A2' is an intersection point between a normal line drawn from the point A2 and the top plate 81 in a side view and is an end point of the curve in the top plate 81. That is, the top plate 81 is formed such that a range from the point A1' to the point A2' is formed as a curved projection portion 87 curved in the longitudinal direction so as to project upward, and a range on the left side from the point A1 and a range on the right side from the point A2' are formed as flat portions.

Note that, in FIG. 2, a point B1 is an intersection point between the top plate 81 and a line inclined leftward from the normal line drawn from the point A1 only by 45° at which shear stress becomes maximum in a side view, and a point C1 is a point shifted leftward from the point B1 only by a predetermined margin C just to be on the safe side. Similarly, a point B2 is an intersection point between the top plate 81 and a line inclined rightward from the normal line drawn from the point A2 only by 45° at which shear stress becomes maximum in a side view, and a point C2 is a point shifted leftward from the point B2 only by a predetermined margin C just to be on the safe side. In the present embodiment, as will be described later, only a range 81*a* (a hatching portion in FIG. 1) from the point C1 to the point C2 in the top plate 81 is pressed by a fifth mold surface 20*a* of the pad 20, and a range 81*b* on the left side from the point C1 in the top plate 81 and a range 81*c* on the right side from the point C2 in the top plate 81 are not pressed by the pad 20.

When the flanges 85 of the hat-shaped section component 80 are joined by spot welding or the like to the flanges 85 of a hat-shaped section component (not shown) opened upward in a reverse manner from the hat-shaped section component 80, an elongated closed section member is formed. The elongated closed section member is used as a vehicle frame member such as a front side member, for example. The following more specifically describes the manufacturing apparatus 1 and the manufacturing method according to the present embodiment each for manufacturing such a hat-shaped section component 80.

Basic Configuration of Manufacturing Apparatus

FIGS. 3 to 6 are cross-sectional views to schematically describe manufacturing procedures 1 to 4 of the hat-shaped section component 80. Note that, in FIGS. 3 to 6, for easy understanding of the figures, hatching is given only to the pad 20, a punch 30, a holder 40, the workpiece 70, and the hat-shaped section component 80 in the cross-sectional views.

Figure 3:
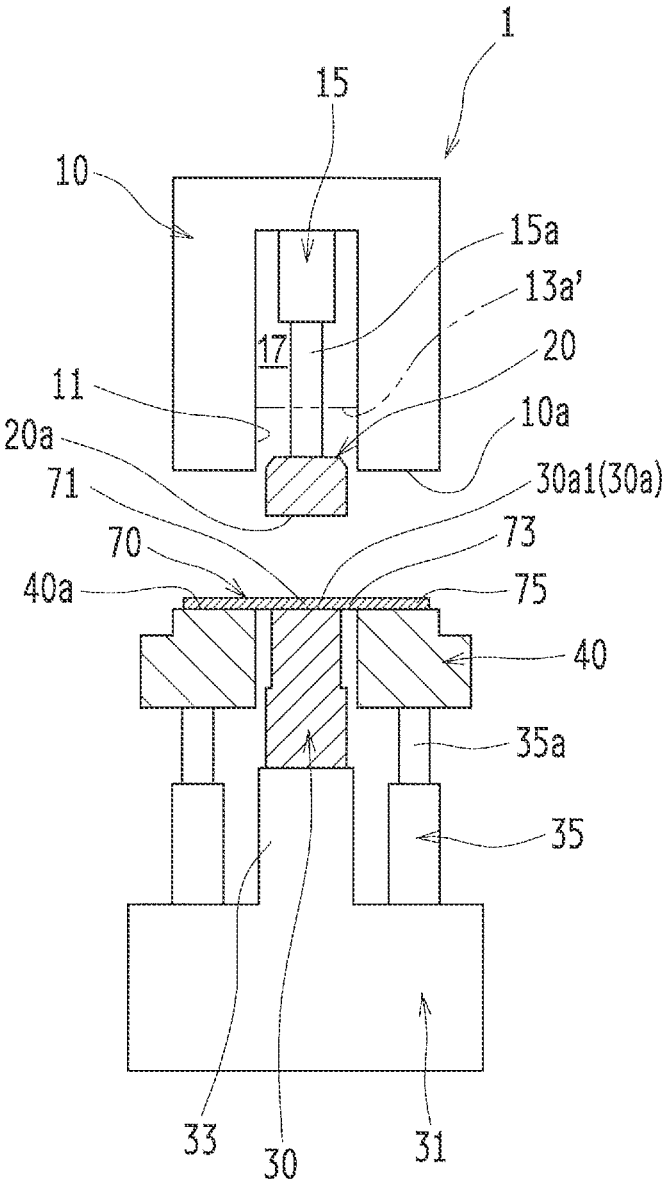
FIG. 3 is a cross-sectional view to schematically describe a manufacturing procedure 1 of the hat-shaped section component.

As illustrated in FIG. 3 and so on, the manufacturing apparatus 1 includes the die 10, the pad 20, the punch 30, and the holder 40 as a metal mold. The manufacturing apparatus 1 manufactures the hat-shaped section component 80 by performing press working on the flat-shaped workpiece 70 put on the punch 30 and the holder 40, as illustrated in FIG. 3.

Punch

The punch 30 has a first mold surface 30*a* facing upward (toward a first side in a pressing direction), the first mold surface 30*a* including a curved projection portion mold surface 30*a*1 a part of which curves in the longitudinal direction so as to project upward (the first side in the pressing direction).

More specifically, as illustrated in FIG. 3 and so on, the punch 30 is attached to a lower die 31 fixed to a bolster plate of a pressing machine (not shown). The lower die 31 includes a punch holder 33 provided in a central part of the lower die 31 so as to extend upward, and the punch 30 is attached to an upper end portion of the punch holder 33. A top face 30*a* of the punch 30 curves generally in a reverse V-shape along the longitudinal direction (curves in the longitudinal direction and projects upward). Thus, the top face 30*a* constitutes the first mold surface 30*a* configured to pressurize a to-become-top-plate portion 71 (a part of the workpiece 70 that is to become the top plate 81 after molding) of the workpiece 70 at the time of press working.

Figure 7:
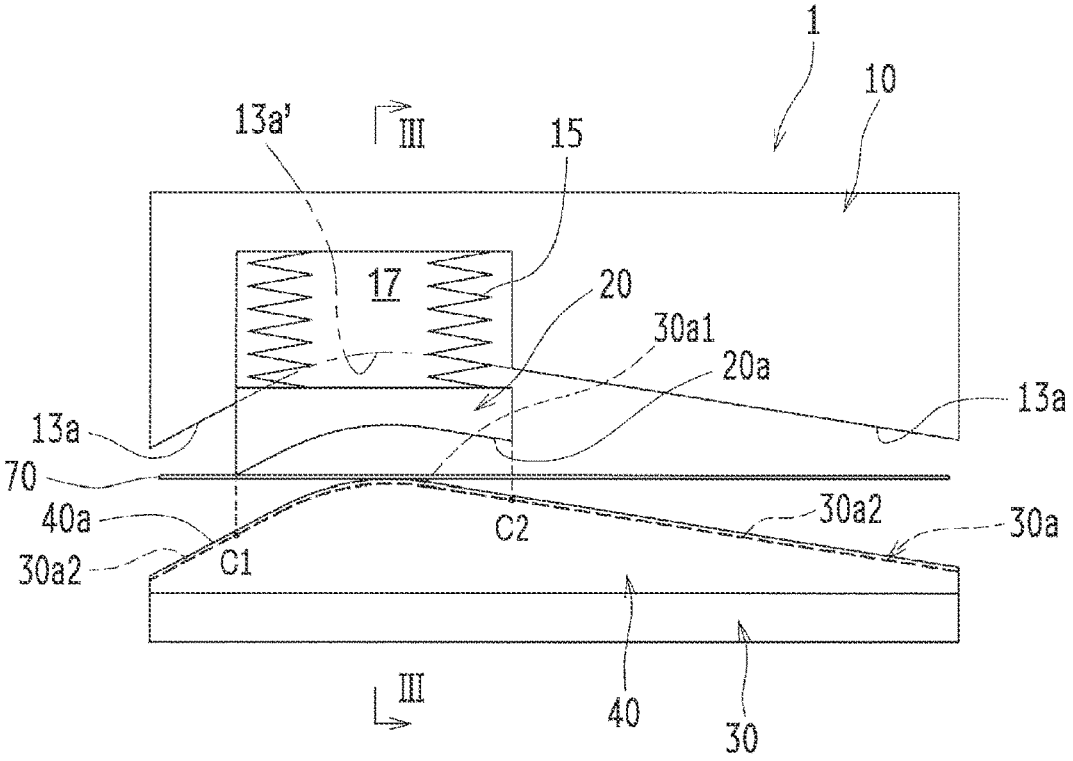
FIG. 7 is a longitudinal-sectional view to schematically describe an essential part of the manufacturing apparatus.

FIG. 7 is a longitudinal-sectional view to schematically describe an essential part of the manufacturing apparatus 1. Note that an alternate long and two short dashes line in FIG. 7 indicates a virtual fourth mold surface 13*a*' in a case where it is assumed that no opening 17 is formed on a fourth mold surface 13*a* of the die 10 (described later), and a thick broken line in FIG. 7 indicates the top face 30*a* (the first mold surface 30*a*) of the punch 30. Further, FIG. 3 corresponds to an arrow sectional view taken along a line in FIG. 7.

As illustrated in FIG. 7, the first mold surface 30*a* includes the curved projection portion mold surface 30*a*1 a part of which is a curved surface, and flat portion mold surfaces 30*a*2 constituted by a flat surface and formed on both outer sides of the curved projection portion mold surface 30*a*1 in the longitudinal direction. The curved projection portion mold surface 30*a*1 corresponds to the range 81*a* from the point C1 to the point C2 in the top plate 81, and the flat portion mold surfaces 30*a*2 correspond to the range 81*b* on the left side from the point C1 in the top plate 81 and the range 81*c* on the right side from the point C2 in the top plate 81. Further, a part of the curved projection portion mold surface 30*a*1 that corresponds to the range from the point A1' to the point A2' in the top plate 81 corresponds to the curved surface constituting the part of the curved projection portion mold surface 30*a*1.

Holder

The holder 40 has a pair of second mold surfaces 40*a* facing upward such that the second mold surfaces 40*a* are placed on both outer sides, in the width direction, of the first mold surface 30*a*. The holder 40 is provided around the punch 30 such that the holder 40 is movable downward against upward biasing force from a state where the second mold surfaces 40*a* are generally flush with the first mold surface 30*a*.

More specifically, as illustrated in FIG. 7, a top face 40*a* of the holder 40 curves generally in a reverse V-shape along the longitudinal direction (curves in the longitudinal direction and projects upward), so as to constitute the second mold surfaces 40*a* configured to pressurize to-become-flange portions 75 (parts to become the flanges 85 after molding) placed in both side portions of the workpiece 70 at the time of press working. The second mold surface 40*a* is formed such that a range corresponding to the range 85*a* from the point A1 to the point A2 in the flange 85 is constituted by a curved surface, and ranges corresponding to the ranges 85*b*, 85*c* on the left side from the point A1 and on the right side from the point A2 in the flange 85 are each constituted by a flat surface.

As illustrated in FIG. 3 and so on, a plurality of nitrogen gas cylinders 35 is provided around the punch holder 33 in the lower die 31, so that rods 35*a* continuously project upward by pressure of nitrogen gas. A bottom end of the holder 40 is attached to upper ends of the rods 35*a* of the nitrogen gas cylinders 35, and thus, the holder 40 is placed around the punch 30. The holder 40 is continuously biased upward by the nitrogen gas cylinders 35. However, when force to press the holder 40 downward is applied to the holder 40, the holder 40 can move downward against the biasing force of the nitrogen gas cylinders 35. Note that the holder 40 is placed on the lower die 31 such that the second mold surfaces 40*a* of the holder 40 become flush with the first mold surface 30*a* of the punch 30 in a state where the holder 40 stays at its uppermost position (the rods 35*a* are fully extended) by being biased upward by the nitrogen gas cylinders 35.

Die

The die 10 includes a pair of third mold surfaces 10*a* and the fourth mold surface 13*a*. The third mold surfaces 10*a* face downward (toward a second side in the pressing direction) such that the third mold surfaces 10*a* face the second mold surfaces 40*a*. The fourth mold surface 13*a* is provided above the third mold surfaces 10*a* via a pair of steps 11 between the third mold surfaces 10*a* so as to face downward such that the fourth mold surface 13*a* faces the first mold surface 30*a*. An opening 17 opened downward is formed in a part, of the fourth mold surface 13*a*, that corresponds to the curved projection portion mold surface 30*a*1 of the punch 30.

More specifically, the die 10 has a generally C-shaped section opened downward and is fixed to a slide of the pressing machine. Similarly to the second mold surfaces 40*a* of the holder 40, bottom end surfaces 10*a* on both outer sides of the die 10 in the width direction curve generally in a reverse V-shape along the longitudinal direction (curve in the longitudinal direction so as to be recessed upward), so as to constitute the third mold surfaces 10*a* configured to pressurize the to-become-flange portions 75 of the workpiece 70 at the time of press working. Therefore, similarly to the second mold surfaces 40*a* of the holder 40, each of the third mold surfaces 10*a* is formed such that a range corresponding to the range 85*a* from the point A1 to the point A2 in the flange 85 is constituted by a curved surface, and ranges corresponding to the ranges 85*b*, 85*c* on the left side from the point A1 and on the right side from the point A2 in the flange 85 are each constituted by a flat surface.

Between the third mold surfaces 10*a*, the fourth mold surface 13*a* facing downward is formed above the third mold surfaces 10*a* via the steps 11 as illustrated in FIG. 7. That is, as illustrated in FIGS. 3 to 6, a groove extending in the longitudinal direction is formed in a bottom end portion of the die 10. The groove is constituted by the steps 11 as side faces and the fourth mold surface 13*a* (the virtual fourth mold surface 13*a*' in FIGS. 3 to 6) as a top face. Thus, the die 10 has a generally C-shaped section opened downward.

When the lower die 31 in which the holder 40 is placed around the punch 30 is fixed to the bolster plate of the pressing machine and the die 10 is fixed to the slide of the pressing machine, the third mold surfaces 10*a* of the die 10 face the second mold surfaces 40*a* of the holder 40 in the up-down direction, and the fourth mold surface 13*a* of the die 10 faces the first mold surface 30*a* of the punch 30 in the up-down direction.

As illustrated in FIGS. 3 to 7, the opening 17 opened downward is formed in a part, of the fourth mold surface 13*a* of the die 10, that corresponds to the curved projection portion mold surface 30*a*1 of the punch 30. As illustrated in FIG. 3 and so on, a plurality of nitrogen gas cylinders 15 is attached to a top face of the opening 17. Rods 15*a* of the nitrogen gas cylinders 15 continuously project downward by pressure of nitrogen gas.

Pad

The pad 20 has the fifth mold surface 20*a* facing downward so as to face the curved projection portion mold surface 30*a*1. The pad 20 is provided in the die 10 so as to be relatively movable upward such that the pad 20 is pushed into the opening 17 against downward biasing force so that the fifth mold surface 20*a* becomes flush with the fourth mold surface 13*a* from a state where the fifth mold surface 20*a* projects downward (the second side in the pressing direction) from the fourth mold surface 13*a*.

More specifically, as illustrated in FIGS. 3 to 7, the pad 20 is provided inside the opening 17 of the die 10, and an upper end of the pad 20 is attached to bottom ends of the rods 15*a* of the nitrogen gas cylinders 15. Hereby, the pad 20 is continuously biased downward by the nitrogen gas cylinders 15. However, when force to press the pad 20 upward is applied to the pad 20, the pad 20 can move upward relative to the die 10 against the biasing force of the nitrogen gas cylinders 15 such that the pad 20 is pushed into the opening 17.

A part of a bottom face 20*a* of the pad 20 curves generally in a reverse V-shape along the longitudinal direction (curves in the longitudinal direction so as to be recessed upward), so as to constitute the fifth mold surface 20*a* configured to pressurize the to-become-top-plate portion 71 of the workpiece 70 at the time of press working. As illustrated in FIG. 7, the pad 20 is placed inside the opening 17 such that the fifth mold surface 20*a* projects downward from the fourth mold surface 13*a*, in a state where the pad 20 stays at its downmost position (the rods 15*a* are fully extended) by being biased downward by the nitrogen gas cylinders 15. Further, as illustrated in FIG. 3, the fifth mold surface 20*a* projects downward from the third mold surfaces 10*a* in a state where the rods 15*a* are fully extended.

As described above, the opening 17 is formed in a part, of the fourth mold surface 13*a*, that corresponds to the curved projection portion mold surface 30*a*1 of the punch 30, and the pad 20 is provided in the opening 17. Accordingly, the fifth mold surface 20*a* of the pad 20 faces the curved projection portion mold surface 30*a*1 of the punch 30 in the up-down direction, so that the fifth mold surface 20*a* presses only the curved projection portion 87 and its surrounding part in the top plate 81 together with the curved projection portion mold surface 30*a*1.

Manufacturing Method

In a case where the hat-shaped section component 80 is manufactured by use of the manufacturing apparatus 1 configured as such, the flat-shaped workpiece 70 is first put on the punch 30 and the holder 40, as illustrated in FIG. 3. More specifically, the workpiece 70 carried by a robot arm 3 (see FIG. 11) is positioned by bringing the workpiece 70 into contact with a positioning gauge 5 (not illustrated in FIGS. 3 to 6, see FIG. 11) provided in the holder 40, such that the to-become-top-plate portion 71 in the workpiece 70 is put on the first mold surface 30*a*, and the to-become-flange portions 75 in the workpiece 70 are put on the second mold surfaces 40*a*. Note that, in this state, force to press the holder 40 downward is not applied to the holder 40, and the rods 35*a* are fully extended. Accordingly, the first mold surface 30*a* of the punch 30 is flush with the second mold surfaces 40*a* of the holder 40 (a workpiece mounting step).

Figure 4:
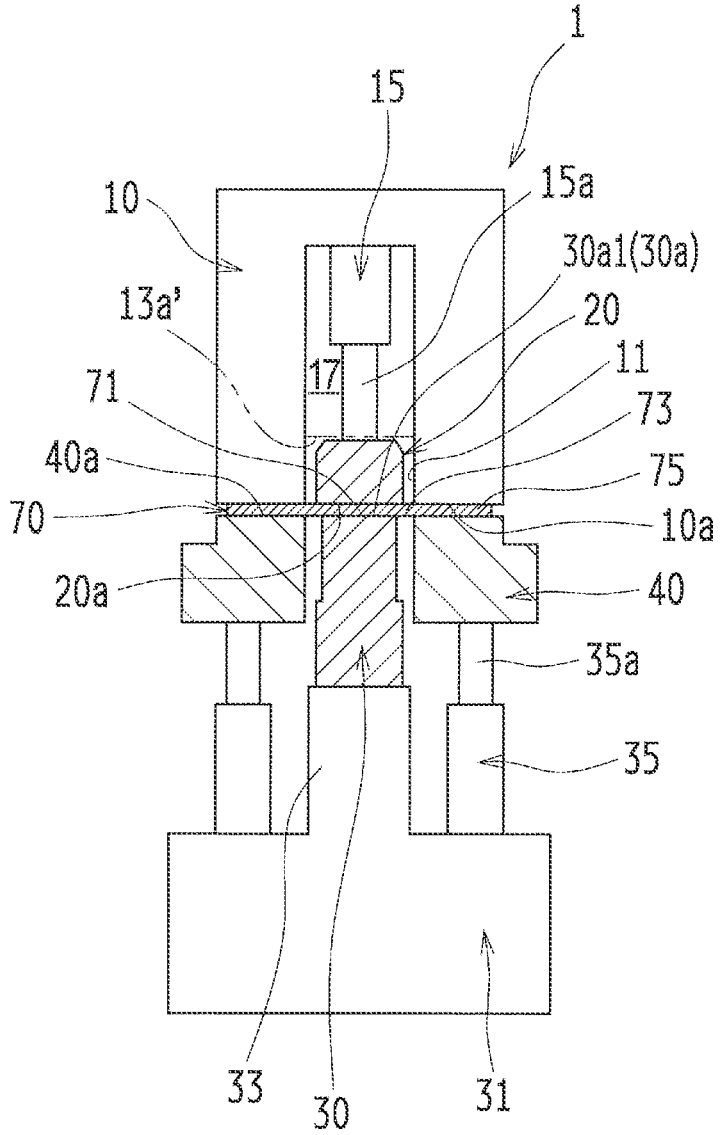
FIG. 4 is a cross-sectional view to schematically describe a manufacturing procedure 2 of the hat-shaped section component.

Subsequently, when the die 10 is moved downward by driving the slide of the pressing machine, a part of the to-become-top-plate portion 71 is sandwiched, in the up-down direction, between the fifth mold surface 20*a*, of the pad 20, that projects downward from the third mold surfaces 10*a* and the curved projection portion mold surface 30*a*1 of the punch 30. When the die 10 is further moved downward from this state, the pad 20 is pushed into the opening 17 against the biasing force of the nitrogen gas cylinders 15 with the part of the to-become-top-plate portion 71 being sandwiched, in the up-down direction, between the pad 20 and the curved projection portion mold surface 30*a*1 of the punch 30. Then, when the die 10 is further moved downward, the part of the to-become-top-plate portion 71 is sandwiched, in the up-down direction, between the fifth mold surface 20*a* and the curved projection portion mold surface 30*a*1, and each of the to-become-flange portions 75 is sandwiched, in the up-down direction, between a corresponding one of the third mold surfaces 10*a* of the die 10 and a corresponding one of the second mold surfaces 40*a* of the holder 40, as illustrated in FIG. 4. That is, the part of the to-become-top-plate portion 71 (a range corresponding to the range 81 a from the point C1 to the point C2 in the top plate 81 after molding) is restricted by the fifth mold surface 20*a* and the curved projection portion mold surface 30*a*1 at this point.

The die 10 is further moved downward from a state where the part of the to-become-top-plate portion 71 is restricted by the fifth mold surface 20*a* and the curved projection portion mold surface 30*a*1. As a result, in terms of the metal mold as a whole, in a state where each of the to-become-flange portions 75 is sandwiched between a corresponding one of the third mold surfaces 10*a* of the die 10 and a corresponding one of the second mold surfaces 40*a* of the holder 40, the punch 30 is pushed into between the steps 11 of the die 10 while the to-become-top-plate portion 71 is pressed upward by the first mold surface 30*a*. When the to-become-top-plate portion 71 is sandwiched, in the up-down direction, between the first mold surface 30*a* of the punch 30 thus pushed into between the steps 11 and a set of the fourth mold surface 13*a* of the die 10 and the fifth mold surface 20*a* of the pad 20, the fifth mold surface 20*a* being flush with the fourth mold surface 13*a*, the hat-shaped section component 80 is molded such that the to-become-top-plate portion 71 is turned into the top plate 81, the to-become-flange portions 75 are turned into the flanges 85, and a part 73 between the to-become-plate portion 71 and each of the to-become-flange portions 75 is turned into the vertical wall 83. At the same time, the to-become-top-plate portion 71 is pressed by the curved projection portion mold surface 30*a*1 a part of which is a curved surface, so that the curved projection portion 87 is formed in the top plate 81 (a molding step).

Figure 8:
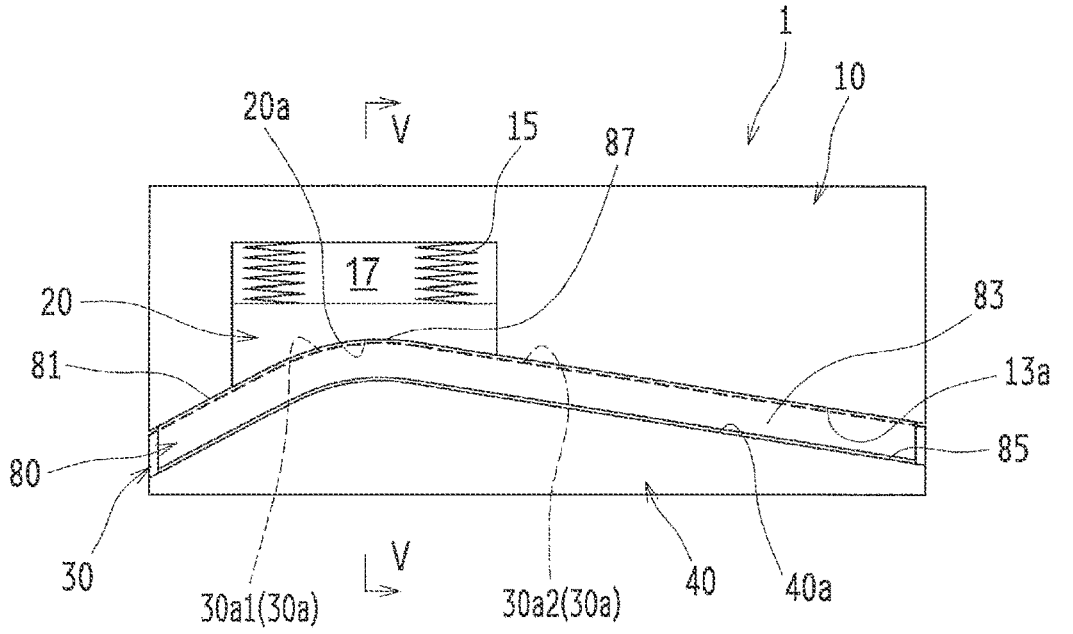
FIG. 8 is a longitudinal-sectional view to schematically describe an essential part of the manufacturing apparatus at the time of molding.

FIG. 8 is a longitudinal-sectional view to schematically describe an essential part of the manufacturing apparatus 1 at the time of molding. Note that a thick broken line in FIG. 8 indicates the top face 30*a* (the first mold surface 30*a*) of the punch 30. Further, FIG. 5 corresponds to an arrow sectional view taken along a line V-V in FIG. 8. Now focus on the curved projection portion mold surface 30*a*1 of the punch 30 and the pad 20. When the die 10 is further moved downward from the state illustrated in FIG. 4, the pad 20 and the punch 30 sandwiching the to-become-top-plate portion 71 therebetween in the up-down direction are distanced in the up-down direction from the die 10 and the holder 40 sandwiching the to-become-flange portions 75 therebetween in the up-down direction, so that the vertical wall 83 is molded between the top plate 81 and each of the flanges 85.

Figure 5:
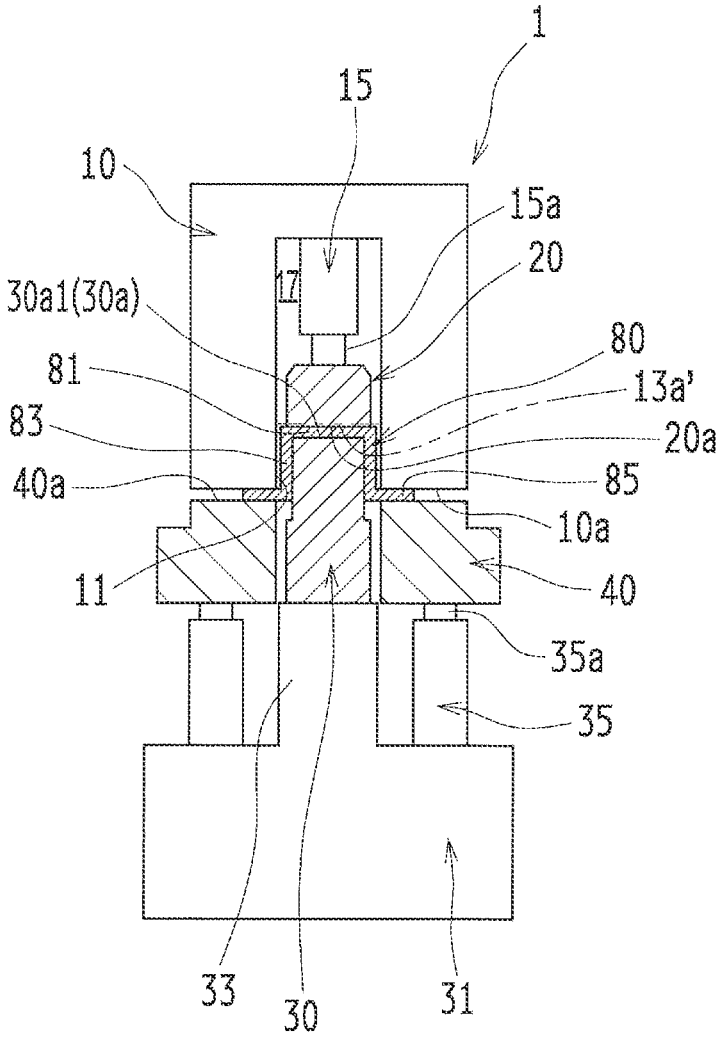
FIG. 5 is a cross-sectional view to schematically describe a manufacturing procedure 3 of the hat-shaped section component.

More specifically, when the die 10 is further moved downward from the state illustrated in FIG. 4, the holder 40 pushed downward by the die 10 moves downward against the biasing force of the nitrogen gas cylinders 35 as illustrated in FIG. 5, and the pad 20 pushed relatively upward by the curved projection portion mold surface 30*a*1 of the punch 30 is pushed into the opening 17 against the biasing force of the nitrogen gas cylinders 15 as illustrated in FIG. 8. When the punch 30 enters between the steps 11 of the die 10 while the punch 30 is pushing the pad 20 as such, the hat-shaped section component 80 having the vertical wall 83 between the top plate 81 and each of the flanges 85 is molded. Meanwhile, since the to-become-top-plate portion 71 is sandwiched between the fifth mold surface 20*a* and the curved projection portion mold surface 30*a*1, the curved projection portion 87 is formed in the top plate 81 (the molding step).

Figure 6:
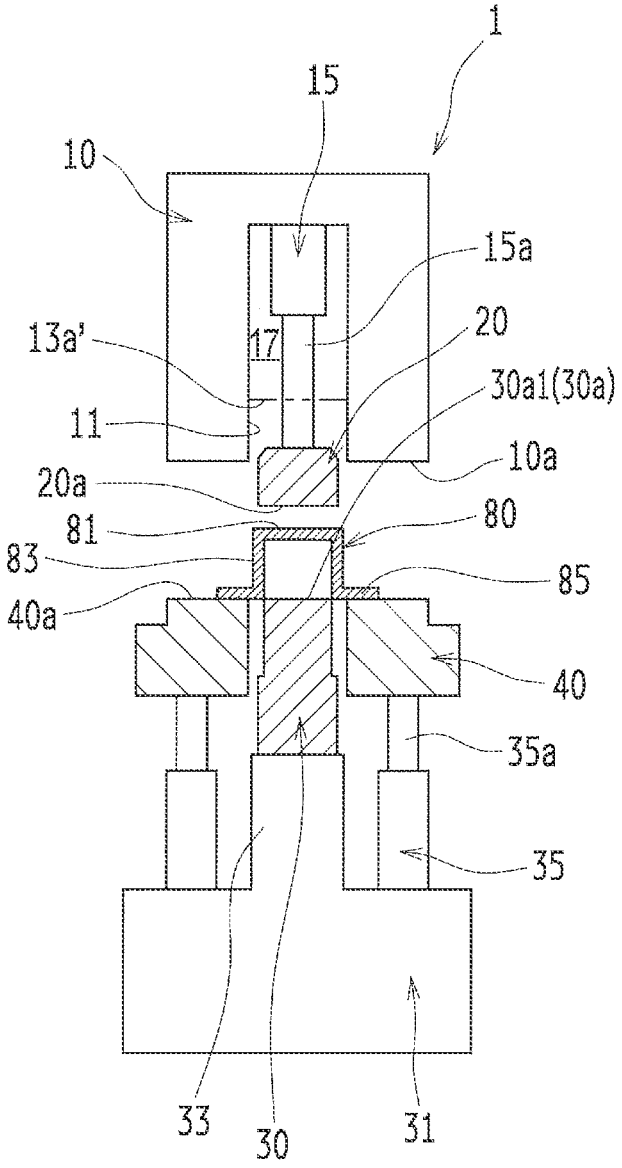
FIG. 6 is a cross-sectional view to schematically describe a manufacturing procedure 4 of the hat-shaped section component.
Figure 9:
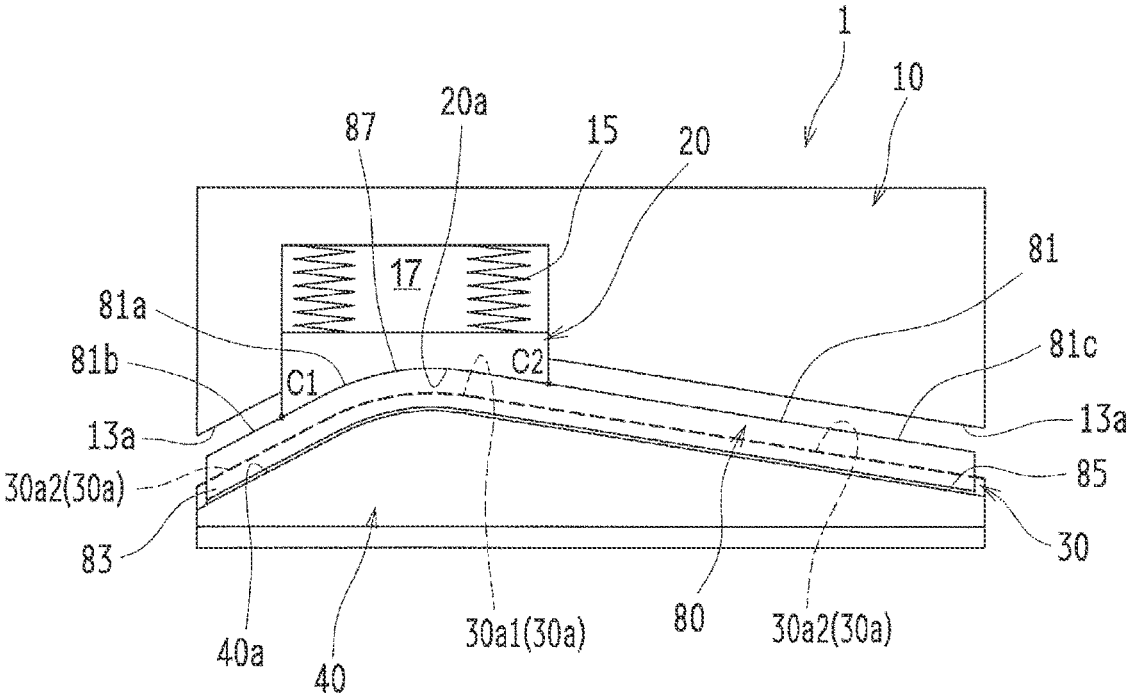
FIG. 9 is a longitudinal-sectional view to schematically describe an essential part of the manufacturing apparatus at the time of mold release.

FIG. 9 is a longitudinal-sectional view to schematically describe an essential part of the manufacturing apparatus 1 at the time of mold release. Note that a thick broken line in FIG. 9 indicates the top face 30*a* (the first mold surface 30*a*) of the punch 30. When the die 10 is moved upward subsequently by driving the slide of the pressing machine, the punch 30 is distanced from a bottom face of the top plate 81 so as to start to be removed from the steps 11 of the die 10 in a state where the fifth mold surface 20*a* makes contact with the top plate 81 as illustrated in FIG. 9, and the holder 40 moves upward due to the biasing force of the nitrogen gas cylinders 35 in a state where the holder 40 and the third mold surfaces 10*a* are sandwiching the flanges 85 therebetween. Then, when the holder 40 reaches its uppermost position, that is, when the second mold surfaces 40*a* of the holder 40 become flush with the first mold surface 30*a* of the punch 30, the fifth mold surface 20*a* of the pad 20 is distanced from a top face of the top plate 81, and demold of the hat-shaped section component 80 is completed as illustrated in FIG. 6 (a mold opening step).

Operations and Effects

Next will be described operations and effects of the present embodiment. Before the operations and effects are described, the following briefly describes a manufacturing apparatus and so on in the related art, for easy understanding of the operations and effects of the present embodiment.

(1) Crack of Top Plate

Figure 12:
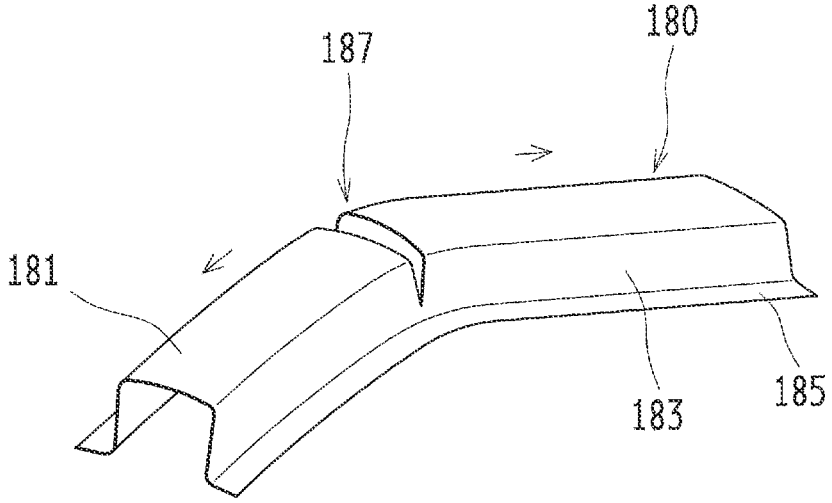
FIG. 12 is a view to schematically describe a mechanism that causes a crack in a top plate.

FIG. 12 is a view to schematically describe a mechanism that causes a crack in a top plate 181. Here, the following fact has been known. That is, similarly to the present embodiment, in a case where a hat-shaped section component 180 including a curved projection portion 187 is manufactured, if a to-become-top-plate portion is not pressed by a pad, a crack is formed in the top plate 181 as illustrated in FIG. 12 in the course of stretch-flanging (a vertical wall 183 is molded between the top plate 181 and a flange 185). More specifically, if there is no restraint force by the pad (hereinafter also referred to as "pad restraint force") that restrains longitudinal displacement (slip) of the to-become-top-plate portion, the to-become-top-plate portion is displaced in the longitudinal direction as indicated by arrows in FIG. 12, thereby resulting in that a crack is formed in the top plate 181 at the curved projection portion 187 where the displacement is large. Further, it has been also known that the pad restraint force to restrain a crack from being formed in the top plate 181 in the course of stretch-flanging increases in proportion to the material strength and the plate thickness of the workpiece.

Therefore, in a case where the hat-shaped section component 180 made of a high tensile material and including the curved projection portion 187 is manufactured similarly to the present embodiment, relatively large pad restraint force is required to restrain a crack from being formed in the top plate 181. In order to achieve such pad restraint force, relatively large pressing force caused by the pad, in other words, relatively large biasing force caused by nitrogen gas cylinders is required.

(2) Deformation of Hat-shaped Section Component in Mold Release

Figure 13:
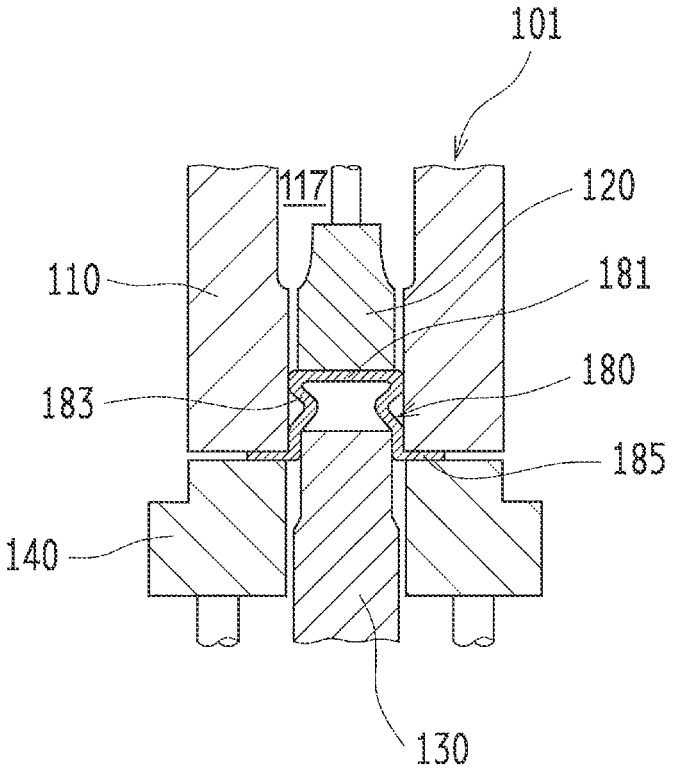
FIG. 13 is a cross-sectional view to schematically describe a manufacturing apparatus of a conventional example 1.

FIG. 13 is a cross-sectional view to schematically describe a manufacturing apparatus 101 in the related art. In the manufacturing apparatus 101 in the related art, as illustrated in FIG. 13, the hat-shaped section component 180 is also molded such that a pad 120 and a punch 130 sandwiching a to-become-top-plate portion of a workpiece therebetween in the up-down direction are distanced in the up-down direction from a die 110 and a holder 140 sandwiching to-become-flange portions of the workpiece therebetween in the up-down direction. This point is the same as the manufacturing apparatus 1 of the present embodiment.

However, in a case where the hat-shaped section component 180 made of a high tensile material and including the curved projection portion 187 is manufactured by use of the manufacturing apparatus 101 in the related art, the following problem occurs. That is, at the time of mold release (at the time of mold opening), when the die 110 is moved upward, the punch 130 is removed from an opening 117 of the die 110, and the pad 120 moves downward due to biasing force in the opening 117 of the die 110. Meanwhile, around the punch 130, the holder 140 moves relatively upward due to biasing force. As a result, the punch 130 is distanced from a bottom face of the top plate 181, and as described above in (1), relatively large pressing force of the pad 120 is applied from above to the top plate 181 that has lost support by the punch 130 from below, the pressing force being to cause pad restraint force to restrain longitudinal displacement of the to-become-top-plate portion. Also, pressing force from the holder 140 is applied to the flanges 185 from below. Consequently, the hat-shaped section component 180 is compressed in the up-down direction due to pressurization by the pad 120 and the holder 140, so that the vertical walls 183 might deform to buckle as illustrated in FIG. 13.

(3) Increase in Thickness of Pad

Figure 14A:
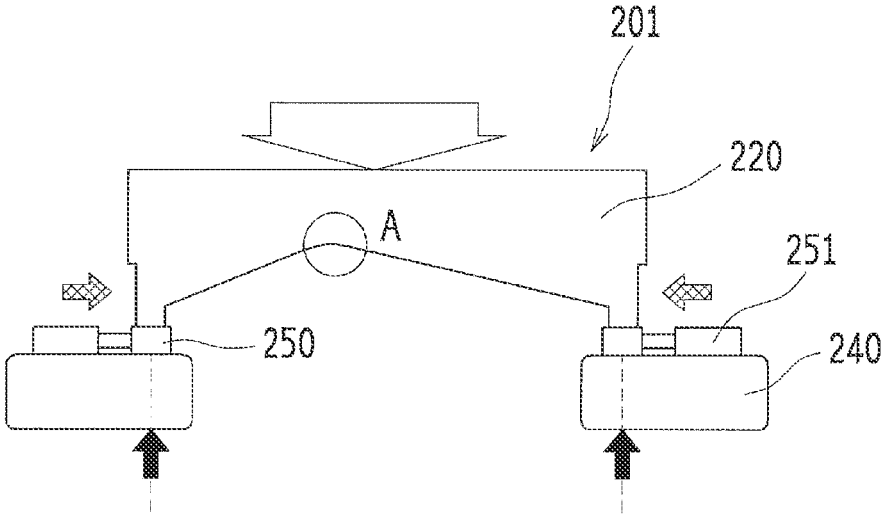
FIG. 14A is a view to schematically describe an essential part of a forming press apparatus of a conventional example 2.
Figure 14B:
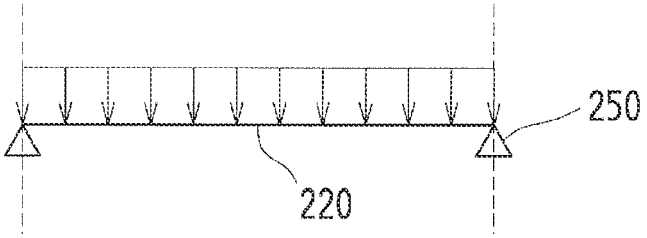
FIG. 14B is a view to schematically describe an essential part of a forming press apparatus of a conventional example 2.
Figure 14C:
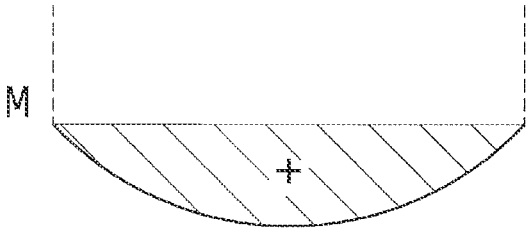
FIG. 14C is a view to schematically describe an essential part of a forming press apparatus of a conventional example 2.

FIG. 14A, FIG. 14B and FIG. 14C are a view to schematically describe an essential part of a manufacturing apparatus 201 in a conventional example 2. In order to restrain the deformation of the hat-shaped section component as described in (2), in the manufacturing apparatus 201 illustrated in FIG. 14A, locking blocks 250 are inserted between a pad 220 and a holder 240. Hereby, pressing force (see a blank arrow in FIG. 14A) of the pad 220 and pressing force (see black arrows in FIG. 14A) of the holder 240 that should be applied to the hat-shaped section component at the time of mold release are received by the locking blocks 250 so as not to be applied to the hat-shaped section component.

More specifically, after mold clamping in which a slide of a pressing machine has been fully moved down but before mold opening in which the hat-shaped section component is demolded and taken out, the locking blocks 250 are moved by respective air cylinders 251 from positions, in the holder 240, where the locking blocks 250 do not face the pad 220 in the up-down direction to positions, in the holder 240, where the locking blocks 250 face the pad 220 in the up-down direction as indicated by hatched arrows in FIG. 14A, and the locking blocks 250 are inserted between end portions of the pad 220 and the holder 240. Thus, a positional relationship, in the up-down direction, between the holder 240 and the pad 220 in a mold clamping state is maintained during mold opening.

The technique using the locking blocks 250 as such is useful to restrain deformation of the hat-shaped section component at the time of mold release. However, in a case where relatively large pressing force (equal to or more than 500 kN, for example) of the pad 220 is applied as described in (1), the following problem occurs. That is, the pad 220 in FIG. 14A is in a state where a uniformly distributed load is applied to a both-end supported simple beam 220 as illustrated in FIG. 14B. Therefore, as illustrated in an M-diagram in FIG. 14C, a maximum bending moment is caused in a central part of the simple beam 220.

That is, in a case where relatively large pressing force of the pad 220 is applied, a relatively large bending moment is caused in a part A of the pad 220 in FIG. 14A. On this account, in order to secure the strength of the pad 220, the thickness of the pad 220 should be relatively increased.

(4) Decrease in Productivity

Figure 15:
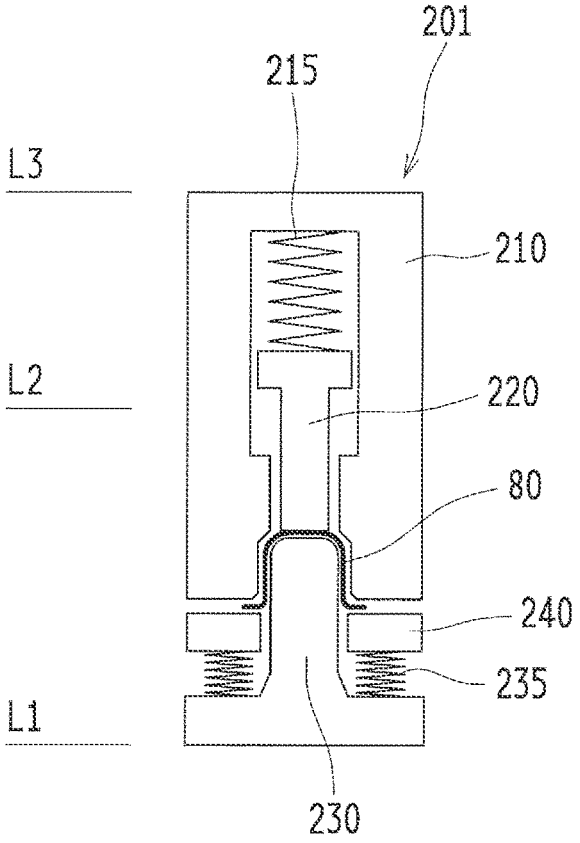
FIG. 15 is a view illustrating the manufacturing apparatus of the conventional example 2 in a simplified manner.
Figure 16:
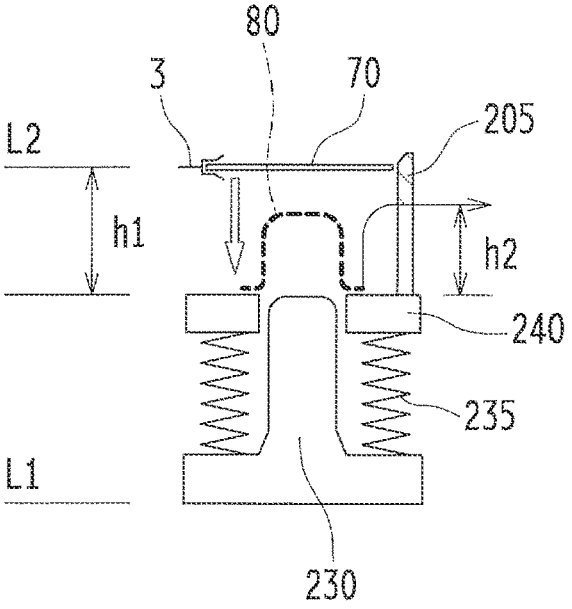
FIG. 16 is a view to schematically describe a state where a workpiece is introduced and a state where a hat-shaped section component is taken out in the manufacturing apparatus of the conventional example 2.

FIG. 15 is a view illustrating the manufacturing apparatus 201 of the conventional example 2 in a simplified manner, and FIG. 16 is a view to schematically describe a state where the workpiece 70 is introduced and a state where the hat-shaped section component 80 is taken out in the manufacturing apparatus 201 of the conventional example 2. Note that, in FIG. 15, a level L1 indicates the height of an upper end of the bolster plate, a level L2 indicates the introduction height of the workpiece 70 by the robot arm 3, and a level L3 indicates the height of a bottom end at the time when the slide is moved down (a molding bottom dead center).

As described in (3), when the thickness of the pad 220 is relatively increased, the die 210 to which the pad 220 is attached via a nitrogen gas cylinder 215 in a relatively movable manner necessarily becomes large (the die 210 is increased in height dimension), as illustrated in FIG. 15. Here, in a factory or the like, it is not realistic to replace the pressing machine or the robot arm 3 every time the material, the thickness, and so on of the hat-shaped section component 80 are changed. On this account, the level L1, the level L2, and the level L3 are fixed. Therefore, the height dimension of a punch 230 including a lower die should be decreased just by the increase in the thickness of the pad 220 (the increase in the height dimension of the die 210). Further, along with the decrease in the height dimension of the punch 230, the height of an upper end (a second mold surface) of the holder 240 in a state where the holder 240 stays at its uppermost position due to a nitrogen gas cylinder 235 is also relatively decreased.

In the meantime, the holder 240 is generally provided with a positioning gauge 205, as illustrated in FIG. 16, so as to position the workpiece 70 when the workpiece 70 is introduced and to restrain displacement of the workpiece 70 at the time of molding. In the manufacturing apparatus 201 of the conventional example 2, the workpiece 70 is also brought into contact with the positioning gauge 205 at the time of introduction of the workpiece 70 so that the workpiece 70 is positioned. However, as described above, the level L2 indicative of the introduction height of the workpiece 70 by the robot arm 3 is fixed. Accordingly, in the manufacturing apparatus 201 of the conventional example 2 in which the height of the upper end of the holder 240 is relatively low, in order that the workpiece 70 is brought into contact with the positioning gauge 205, the height dimension of the positioning gauge 205 should be increased necessarily.

After the workpiece 70 is brought into contact with the positioning gauge 205 at the time of introduction of the workpiece 70, the workpiece 70 is dropped as indicated by a blank arrow in FIG. 16. However, since a dropping amount h1 is large, such a problem occurs that positioning accuracy decreases. Also, at the time when the hat-shaped section component 80 is taken out after molding, since the height dimension of the positioning gauge 205 exceeds a movable range h2 of the robot arm 3 in the up-down direction, there is also such a problem that the hat-shaped section component 80 interferes with the positioning gauge 205.

Furthermore, at the time of introduction of the workpiece 70, it takes time until a bottom end of the pad 220 reaches a sufficient height (a height at which a gap to such an extent that the workpiece 70 can be inserted therein is formed between an upper end of the punch 230 and the bottom end of the pad 220) by raising the slide. However, in the manufacturing apparatus 201 of the conventional example 2 in which the thickness of the pad 220 is relatively large, it takes longer time before the bottom end of the pad 220 reaches the sufficient height after completion of molding of the hat-shaped section component 80, that is, it takes longer time before a subsequent workpiece 70 is introduced into the metal mold. This causes such a problem that the productivity decreases.

In terms of those problems, the manufacturing apparatus 1 of the present embodiment employs the pad 20 configured to partially press only the curved projection portion 87 and its surrounding part in the top plate 81. This can solve all the above problems (1) to (4) as described below.

First, as can be understood from a case where a flat component is molded by drawing, longitudinal displacement of the to-become-top-plate portion 71 that might cause a crack in the top plate 81 occurs such that displacement caused in a part (hereinafter also referred to as a "to-be-curved portion") corresponding to the curved projection portion 87 is transmitted over the whole length in the longitudinal direction, and no longitudinal displacement occurs in a flat part other than the part corresponding to the curved projection portion 87.

In this respect, in the manufacturing apparatus 1 of the present embodiment, when the punch 30 is pushed into between the steps 11 of the die 10, the to-be-curved portion pressed by the curved projection portion mold surface 30*a*1 first abuts with the fifth mold surface 20*a* and is sandwiched, in the up-down direction, between the curved projection portion mold surface 30*a*1 and the fifth mold surface 20*a*, so that the to-be-curved portion is restricted in the longitudinal direction. When the punch 30 is further pushed into between the steps 11 in a state where the to-be-curved portion is restricted by the curved projection portion mold surface 30*a*1 and the fifth mold surface 20*a*, the to-become-top-plate portion 71 is sandwiched, in the up-down direction, between the first mold surface 30*a* and a set of the fourth mold surface 13*a* and the fifth mold surface 20*a* flush with the fourth mold surface 13*a* over the whole length. Hereby, without causing longitudinal displacement in the to-become-top-plate portion 71, in other words, without causing a crack in the top plate 81, the top plate 81 including the curved projection portion 87 can be formed (the problem (1) is solved).

As such, the workpiece 70 is not restricted over the whole length in the longitudinal direction, and only a part, of the workpiece 70, which corresponds to the curved projection portion mold surface 30*a*1 and in which longitudinal displacement easily occurs is partially restricted by the pad 20. This makes it possible to relatively shorten the whole length of the pad 20 in the longitudinal direction. Hereby, in the manufacturing apparatus 1 of the present embodiment, while the top plate 81 including the curved projection portion 87 can be formed without causing a crack in the top plate 81, it is possible to relatively decrease pressing force applied to the pad 20 itself.

Here, pressing force per unit length in the curved projection portion mold surface 30*a*1 in the manufacturing apparatus 1 of the present embodiment is the same as that in the case where the workpiece 70 is restricted by the pad 220 over the whole length in the longitudinal direction like the manufacturing apparatus 201 of the conventional example 2. However, as illustrated in FIG. 9, in the present embodiment, the pressing force of the pad 20 at the time of mold release is applied from above to only the range 81*a* from the point C1 to the point C2 in the top plate 81, and the range 81*b* on the left side from the point C1 in the top plate 81 and the range 81*c* on the right side from the point C2 in the top plate 81 are not pressed by the pad 20. On this account, the pressing force of the pad 20 to be applied to the range 81*a* is dispersed to the range 81*b* and the range 81*c*. Accordingly, even without using the locking blocks 250, it is possible to restrain deformation of the hat-shaped section component 80 as illustrated in FIG. 13 (the problem (2) is solved).

Further, as described above, it is possible to relatively decrease pressing force applied to the pad 20 itself. Accordingly, it is not necessary to relatively increase the thickness of the pad 20 in order to secure the strength of the pad 20. This accordingly makes it possible to relatively decrease the thickness of the pad 20 (the problem (3) is solved).

Figure 10:
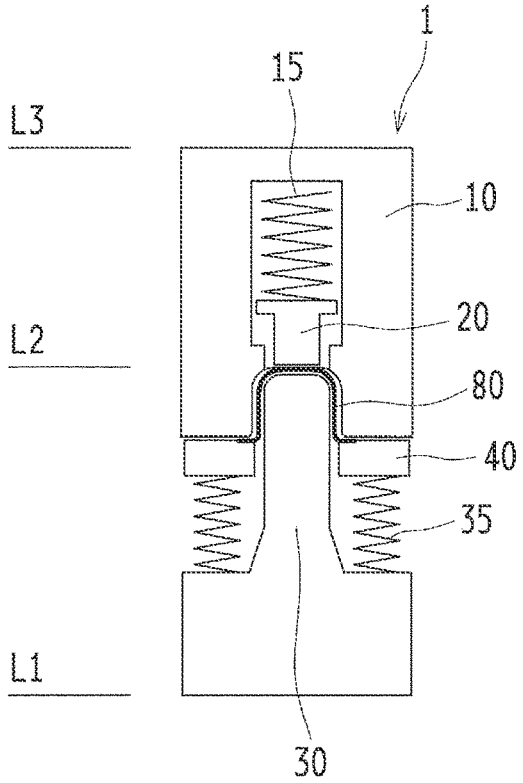
FIG. 10 is a view illustrating the manufacturing apparatus in a simplified manner.
Figure 11:
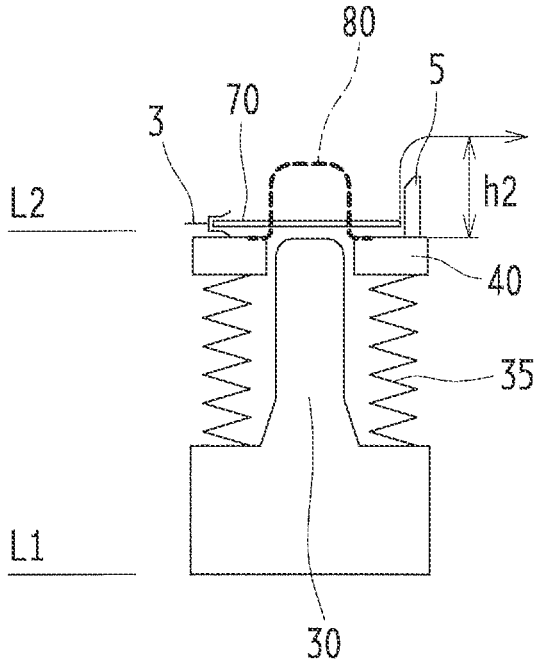
FIG. 11 is a view to schematically describe a state where a workpiece is introduced and a state where the hat-shaped section component is taken out in the manufacturing apparatus.

FIG. 10 is a view illustrating the manufacturing apparatus 1 in a simplified manner. FIG. 11 is a view to schematically describe a state where the workpiece 70 is introduced and a state where the hat-shaped section component 80 is taken out in the manufacturing apparatus 1. Note that, in FIG. 10, a level L1 indicates the height of the upper end of the bolster plate, a level L2 indicates the introduction height of the workpiece 70 by the robot arm 3, a level L3 indicates the height of a bottom end at the time when the slide is moved down (a molding bottom dead center).

In the manufacturing apparatus 1 of the present embodiment, when the thickness of the pad 20 is relatively decreased, the die 10 can be made small necessarily (the height dimension can be decreased) as illustrated in FIG. 10. Therefore, the height dimension of the punch 30 including the lower die can be increased just by the decrease in the thickness of the pad 20 (the decrease in the height dimension of the die 10). Further, along with the increase in the height dimension of the punch 30, the height of the upper end (the second mold surface 40*a*) of the holder 40 can be also relatively increased. As such, in the manufacturing apparatus 1 in which the height of the upper end of the holder 40 is relatively high, the height dimension of the positioning gauge 5 with which the workpiece 70 is brought into contact at the time of introduction of the workpiece 70 can be relatively decreased as illustrated in FIG. 11.

Accordingly, a dropping amount of the workpiece 70 after the workpiece 70 is brought into contact with the positioning gauge 5 at the time of introduction of the workpiece 70 is extremely small, thereby making it possible to improve positioning accuracy. Further, at the time when the hat-shaped section component 80 is taken out after molding, the height dimension of the positioning gauge 5 does not exceed the movable range h2 of the robot arm 3 in the up-down direction. This makes it possible to take out the hat-shaped section component 80 without interfering with the positioning gauge 5.

Further, at the time of introduction of the workpiece 70, it takes time until the bottom end of the pad 20 reaches a sufficient height by raising the slide. However, in the manufacturing apparatus 1 of the present embodiment in which the thickness of the pad 20 is relatively small, it takes shorter time before the bottom end of the pad 20 reaches the sufficient height after completion of molding of the hat-shaped section component 80, that is, it takes shorter time before a subsequent workpiece 70 is introduced into the metal mold. This makes it possible to restrain a decrease in productivity (the problem (4) is solved).

As described above, with the manufacturing apparatus 1 and the manufacturing method of the present embodiment, it is possible to restrain a decrease in productivity and occurrence of a crack in the top plate 81.

OTHER EMBODIMENTS

The present disclosure is not limited to the above embodiment and can be carried out in other various forms without departing from the spirit or main feature of the present disclosure.

In the above embodiment, a press direction (the pressing direction) is along the up-down direction. However, the present disclosure is not limited to this, and the press direction may be set in any direction.

Further, in the above embodiment, the point C1 and the point C2 shifted outward in the longitudinal direction from the point B1 and the point B2 only by the predetermined margin C just to be on the safe side are set, and the length of the pad 20 in the longitudinal direction is determined so that the range 81*a* from the point C1 to the point C2 in the top plate 81 is pressed. However, the present disclosure is not limited to this. For example, the length of the pad 20 in the longitudinal direction may be determined so that a range from the point B1 to the point B2 in the top plate 81 is pressed.

Further, in the above embodiment, the biasing force is given to the pad 20 and the holder 40 by the nitrogen gas cylinders 15, 35, respectively. However, the present disclosure is not limited to this. The biasing force may be given to the pad 20 and the holder 40 by use of an elastic body such as a spring (not shown) other than the gas cylinder, for example.

Thus, the above embodiment is just an example in every respect and must not be interpreted restrictively. Further, modifications and alterations belonging to an equivalent range of Claims are all included in the present disclosure.

With the present disclosure, it is possible to restrain a decrease in productivity and occurrence of a crack in a top plate. Accordingly, the present disclosure is extremely useful when the present disclosure is applied to a manufacturing apparatus and a manufacturing method for a hat-shaped section component including a curved projection portion.

What is claimed is:

1. A manufacturing apparatus configured to manufacture a hat-shaped section component including a curved projection portion curved in a longitudinal direction projecting upward, in a direction from the punch to the die, the manufacturing apparatus comprising:

a punch, the punch having a first mold surface facing upward, the first mold surface including a curved projection portion mold surface a part of which curves in the longitudinal direction so as to project upward;

a holder, the holder having a pair of second mold surfaces facing upward, the pair of second mold surfaces being provided on two outer sides of the first mold surface in a width direction of the manufacturing apparatus;

a die, the die having a pair of third mold surfaces and a fourth mold surface, the third mold surfaces facing downward so as to face the pair of second mold surfaces, the fourth mold surface being provided between the third mold surfaces via steps such that the fourth mold surface is placed higher than the third mold surfaces, the fourth mold surface facing downward so as to face the first mold surface, the fourth mold surface having an opening opened downward, the opening being formed in a part of the fourth mold surface that corresponds to the curved projection portion mold surface; and a pad provided in the opening in the fourth mold surface of the die and having a fifth mold surface facing downward so as to face the curved projection portion mold surface, an upper end of the pad being attached to bottom ends of rods of gas cylinders, the pad being configured to be movable farther upward into the opening against a downward biasing force of the gas cylinders so that the fifth mold surface becomes flush with the fourth mold surface from a state where the fifth mold surface projects downward from the fourth mold surface, wherein a total length of the pad in the longitudinal direction is less than a total length of the die in the longitudinal direction, and a total length of the opening in the longitudinal direction is less than the total length of the die in the longitudinal direction, and wherein the pad, the punch, and the gas cylinders are configured to cooperate to produce a restraint force in order to restrain a crack from being formed in the to-become-top-plate portion of the workpiece.

2. The manufacturing apparatus according to claim 1, wherein:

the holder is provided around the punch such that the holder is movable upward against a biasing force on the holder from a state where the second mold surfaces are generally flush with the first mold surface.

3. A manufacturing method for manufacturing a hat-shaped section component including a curved projection portion by pressing a flat-shaped workpiece, the curved projection portion being curved in a longitudinal direction so as to project upward, in a direction from the punch to the die, the manufacturing method comprising:

providing a manufacturing apparatus including a punch having a first mold surface facing upward, the first mold surface including a curved projection portion mold surface a part of which curves in the longitudinal direction so as to project upward, a holder having a pair of second mold surfaces facing upward, the pair of second mold surfaces being provided on both outer sides of the first mold surface in a width direction of the manufacturing apparatus, a die having a pair of third mold surfaces and a fourth mold surface, the third mold surfaces facing downward so as to face the pair of second mold surfaces, the fourth mold surface being provided between the third mold surfaces via steps such that the fourth mold surface is placed higher than the third mold surfaces, the fourth mold surface facing toward the first mold surface, the fourth mold surface having an opening opened downward, the opening being formed in a part of the fourth mold surface configured to cooperate with the curved projection portion mold surface, and a pad provided in the opening in the fourth mold surface of the die and having a fifth mold surface facing downward so as to face the curved projection portion mold surface, an upper end of the pad being attached to bottom ends of rods of gas cylinders, the pad being configured to be movable farther upward into the opening against a downward first biasing force of the gas cylinders so that the fifth mold surface becomes flush with the fourth mold surface from a state where the fifth mold surface projects downward from the fourth mold surface, wherein a total length of the pad in the longitudinal direction is less than a total length of the die in the longitudinal direction, and a total length of the opening in the longitudinal direction is less than the total length of the die in the longitudinal direction; and molding the hat-shaped section component by pressing the workpiece, the hat-shaped section component having a vertical wall between a top plate and a flange, and the curved projection portion, the molding including sandwiching a to-become-flange portion of the workpiece between a corresponding one of the second mold surfaces and a corresponding one of the third mold surfaces, and pressing a to-become-top-plate portion of the workpiece by moving the first mold surface upward while sandwiching a part in the to-become-top-plate portion corresponding to the curved projection portion between the fifth mold surface and the curved projection portion mold surface, wherein the pad, the punch, and the gas cylinders cooperate to produce a restraint force in order to restrain a crack from being formed in the to-become-top-plate portion of the workpiece.

4. The manufacturing method according to claim 3, wherein:

the holder is provided around the punch such that the holder is movable upward against a second biasing force on the holder from a state where the second mold surfaces are generally flush with the first mold surface; and the molding includes molding the vertical wall between the top plate and the flange by vertically distancing the pad and the punch sandwiching the to-become-top-plate portion from the die and the holder sandwiching the to-become-flange portion.

5. The manufacturing method according to claim 3, wherein the workpiece is made of high tensile steel.

6. The manufacturing apparatus according to claim 1, wherein the steps are defined by side surfaces of the opening.

7. The manufacturing method according to claim 3, wherein the steps are defined by side surfaces of the opening.

8. The manufacturing apparatus according to claim 1, wherein a width of the opening in the width direction of the manufacturing apparatus is constant.

9. The manufacturing method according to claim 3, wherein a width of the opening in the width direction of the manufacturing apparatus is constant.

10. The manufacturing apparatus according to claim 1, wherein the fifth mold surface projects downward from the third mold surfaces in a state where the rods are fully extended.

11. The manufacturing method according to claim 3, wherein the fifth mold surface projects downward from the third mold surfaces in a state where the rods are fully extended.

* * * * *